United States Patent [19]

Thurner

[11] 4,067,168

[45] Jan. 10, 1978

[54] CONNECTING ELEMENT FOR A COMPOSITE BEAM

[75] Inventor: Elmar Thurner, Gisingen, Germany

[73] Assignee: Hilti Aktiengesellschaft, Schaan, Liechtenstein

[21] Appl. No.: 701,941

[22] Filed: July 1, 1976

[30] Foreign Application Priority Data

July 9, 1975 Germany ..... 7521823[U]

[51] Int. Cl.[2] ..... E04B 1/16; E04C 5/01

[52] U.S. Cl. ..... 52/733; 52/334; 52/698; 52/714; 403/279; 403/282; 403/283; 403/405

[58] Field of Search ..... 52/334, 733, 714, 698, 52/521, 549, 483, 478; 403/279, 282, 283, 405

[56] References Cited

U.S. PATENT DOCUMENTS

| | | | |
|---|---|---|---|
| 981,362 | 1/1911 | Bell | 52/549 |
| 1,616,427 | 2/1927 | Isaacson | 52/714 |
| 1,775,780 | 9/1930 | Papalas | 52/714 |
| 2,132,220 | 10/1938 | Powers | 52/334 |
| 2,229,671 | 1/1941 | Powers | 52/334 |
| 2,340,176 | 1/1944 | Cueni et al. | 52/334 |
| 3,177,619 | 4/1965 | Benjamin | 52/334 X |

FOREIGN PATENT DOCUMENTS

| | | | |
|---|---|---|---|
| 1,077,852 | 3/1960 | Germany | 52/334 |

*Primary Examiner*—Alfred C. Perham
*Attorney, Agent, or Firm*—Toren, McGeady and Stanger

[57] ABSTRACT

In a composite beam, a connecting element interconnects a concrete slab and a downwardly depending structural steel member. The connecting element is L-shaped having an elongated base member which is secured by one or more fastening elements to the structural steel member and an elongated anchor strap extending angularly from the base member and incorporated into the concrete slab. Supporting webs are secured to and extend between the base member and the anchor strap. The part of the base member encircling the openings through which the fastening elements pass is deformed to provide rounded recesses. The anchor strap can be made more rigid by forming a corrugation-like recess extending in the elongated direction of the strap. When a force is applied to the anchor strap causing it to move angularly away from the base member, the support webs cause the adjacent surfaces of the base member to act as deformation zones relieving the force on the connection between the base member and the structural steel member.

10 Claims, 4 Drawing Figures

CONNECTING ELEMENT FOR A COMPOSITE BEAM

SUMMARY OF THE INVENTION

The invention is directed to a connecting member for providing interconnection between the concrete slab portion and downwardly depending structural steel member of a composite beam and, more particularly, it is directed to a L-shaped member having a base member through which fastening elements are driven into the structural steel member and an anchor strap which extends substantially at right angles to the base member and is incorporated into the concrete slab.

In composite beams, the upper chord of the beam is formed of a reinforced concrete slab and its lower chord consists of a structural steel member, that is, a structural steel section or a lattice truss or girder. A shear-resistant connection is required between the upper and lower chords so that the full moment of inertia of the beam can be utilized.

To provide the desired interconnection, it has been known to secure connecting elements to the lower chord, that is, to the structural steel member which form an anchorage for the concrete slab to be cast onto the structural steel member. Since longitudinal changes occur between the upper and lower chords of the composite beam under load, the projections provided by the connecting elements must be able to absorb bending stresses to insure the bonding action.

Further, it has been known to use rolled sections and round bolts welded to the structural steel member as connecting elements. While such elements are satisfactory in absorbing bending stresses, it is problematical whether an effective fastening to the steel section or lattice truss or girder is achieved. One of the primary problems involved is that the structural steel member is usually covered with an anticorrosive coat which has an adverse effect on the welded joint. Even timeconsuming cleaning of the welded joint does not substantially improve its quality, because the humid environment, e.g., the weather conditions, in which the welded joint must be produced has a negative effect on it.

The use of bolts inserted by means of explosive charge driven setting guns into the structural steel member as connecting elements does not provide the desired effect, because the connecting elements, though simple to secure, do not withstand the bending stresses which occur. These elements break under the plastic bending deformations which develop and lead to a failure of the bond between the upper and lower chords of the composite beam.

The object of the invention is to provide a connecting element for optimum interconnection which can withstand both the expected bending stresses and deformations.

In accordance with the present invention, the problems experienced in the past are overcome by providing supporting webs attached between the base member and anchor strap of the connecting element with the webs located outside the area of the base member through which the fastening elements extend. The part of the base member extending between the supporting webs and the openings through which the fastening elements are secured, provide deformation zones for absorbing certain of the forces developed when there is differential movement between the different parts of the composite beam.

In carrying out the invention, the connecting element is secured to the structural steel member by means of fastening elements driven into the steel member by an explosive charge driven setting gun. Openings are provided through the connecting element surrounded by recessed surfaces through which the fastening elements are anchored into the structural steel member. The fastening elements pass through the base member of the connecting element and an anchor strap extends angularly from the base member and is also connected to it by supporting webs, the anchor strap absorbs the shearing forces in the concrete slab. Due to the supporting webs, the anchor strap is not merely bent relative to the base member by the shearing forces, rather these forces are transmitted to the base member over the supporting webs. Depending upon the direction of the stress applied to the anchor strap, either the supporting webs or the base member absorb the stresses. If the stress is directed toward the base, the supporting webs are bent slightly inwardly or outwardly and permit a deflection of the anchor strap which can be controlled by corresponding dimensioning of the strap. If the stress is directed away from the base member, the supporting webs pull the base member slightly upwardly, however, due to the provision of the deformation zones in the base member this pulling action has no deleterious effect on the fastening elements. Further, the deflection of the anchor strap can be controlled by suitably dimensioning the deformation zone portions of the base member.

If the deflection of the anchor strap can not be absorbed in the deformation zones of the base member, that is, by the combination of the base member and the supporting webs, no harmful stress is developed in the fastening elements, because the base member is lifted around one of its edges with the result that the fastening elements are stressed only in tension. As a result, shearing and bending stresses which are harmful to the fastening elements do not appear. To counteract the tensile stresses, the base member has specially shaped surfaces for the fastening elements with the surfaces spaced apart in the longitudinal direction of the base member where two or more fastening elements are used.

To prevent the shearing forces which act directly on the base member from exerting any shearing stress on the fastening elements, the surfaces encircling the openings through which the fastening elements are driven, are preferably formed as frusto-conically shaped stampings or recesses with the concave surface of the recess facing toward the surface of the structural steel member into which the fastening element is inserted. These recesses provide cavities at the point at which the fastening elements are driven into the structural steel member into which material can flow from the steel member, which is displaced during the driving of the fastening element. In this way, a form-locked connection is obtained between the base member and the structural steel member which is capable of absorbing any shearing forces which develop.

To provide sufficient rigidity in the elongated direction of the base member for absorbing tilting moments and for ensuring uniform distribution of the forces acting on the supporting webs, a supporting web is provided along each of the long sides of the base member with the web extending for the full length of the long side. The deformation zones in the base member can be controlled, depending on the distance between the location of the openings through which the fastening elements are inserted and the supporting webs extending along the edges of the base member.

The rigidity of the anchor strap can be varied in accordance with the length over which the supporting webs are attached to the anchor strap. If the supporting webs are secured over the entire length of the anchor strap, the rigidity of the strap is so great that for practical purposes the entire deformation takes place in the base member. If the supporting webs extend only over a portion of the length of the anchor strap, a part of the bending stress can be absorbed by the strap itself and its rigidity can be increased by providing a longitudinally extending corrugation-like recess in the strap.

Further, to increase the holding values of the anchor strap in the concrete slab, the end of the anchor strap away from the base member can be bent at substantially right angles.

The various features of novelty which characterize the invention are pointed out with particularity in the claims annexed to and forming a part of this disclosure. For a better understanding of the invention, its operating advantages and specific objects attained by its use, reference should be had to the accompanying drawing and descriptive matter in which there is illustrated and described a preferred embodiment of the invention.

DETAIL DESCRIPTION OF THE INVENTION

Figure 1:
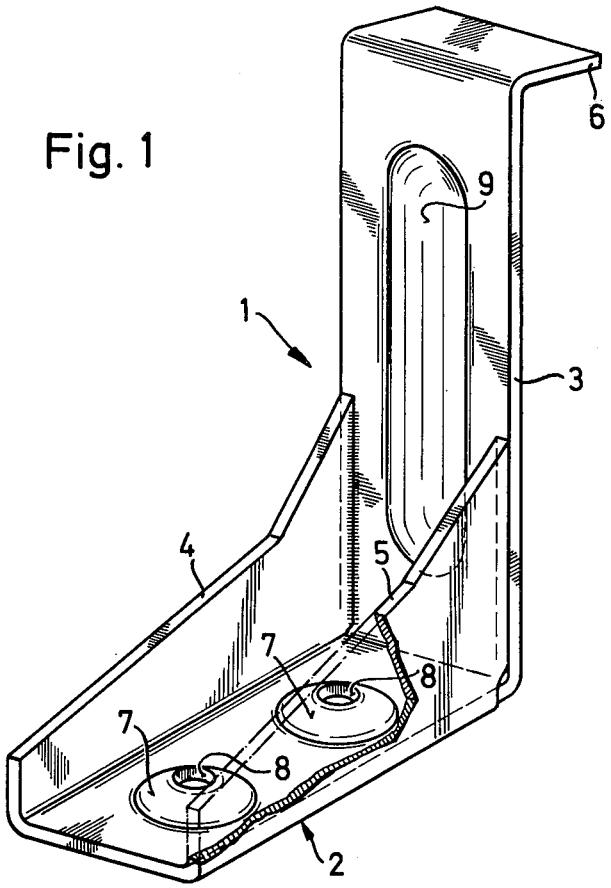
FIG. 1 is a perspective view, partly broken away, of a connecting element embodying the present invention.

In FIG. 1 a connecting element 1 is illustrated consisting of an elongated base member 2 and an elongated anchor strap 3 connected to one end of and extending upwardly from the base member. A supporting web 4, 5 extends along each of the long sides or edges of the base member and the webs extend upwardly and are secured to the edge surface of the anchor strap which faces toward the base member. While the supporting webs 4, 5 extend along the full length of the base member they only extend along a portion of the length of the anchor strap. At the upper end of the anchor strap 3 spaced from its connection to the base member 2, there is a bent edge 6. Furthermore, a corrugation-like recess 9 is formed in the surface of the anchor strap and extends in the elongated direction, the recess affords additional rigidity to the strap. Spaced inwardly from the long and short sides or edges of the base member 2 are points of attachment 7 in the form of frusto-conically shaped stampings or recesses each with a centrally located hole 8. The fastening elements 12 are driven downwardly through the openings or holes 8 for securing the base member 2 to a structural steel member.

Figure 2:
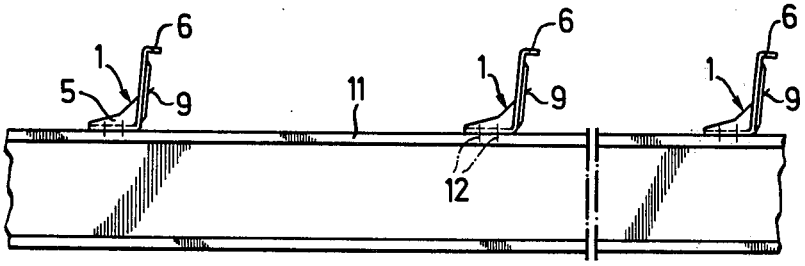
FIG. 2 is a partial side view of a steel section girder showing the fastening elements attached to the girder before the concrete slab is poured.

In FIG. 2, the structural steel member is a steel section girder 11 with the connecting elements 1 anchored to the upper surface of its top flange. With the connecting elements secured in the manner represented in FIG. 2, a concrete slab, not shown, is poured over the steel section girder 11 incorporating the connecting elements.

Figure 3:
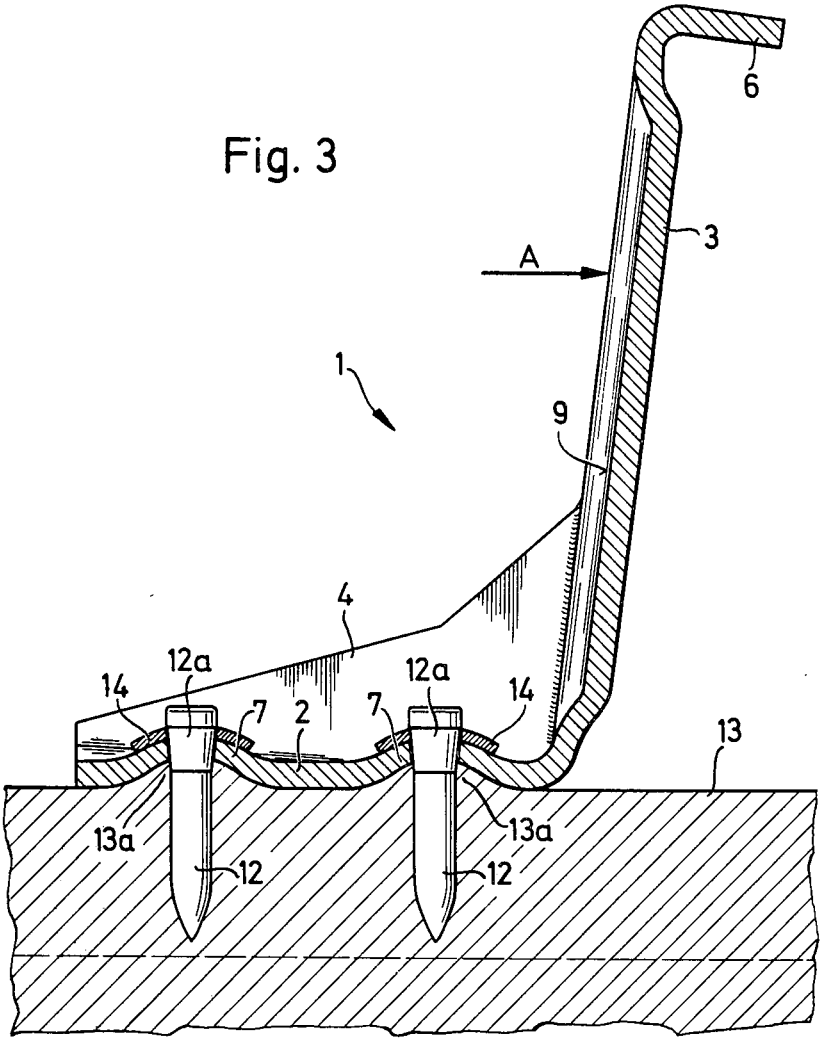
FIG. 3 is a cross-sectional view of the connecting element shown in FIG. 1 secured to a steel section girder and indicating the deformation caused by an applied shearing force.
Figure 4:
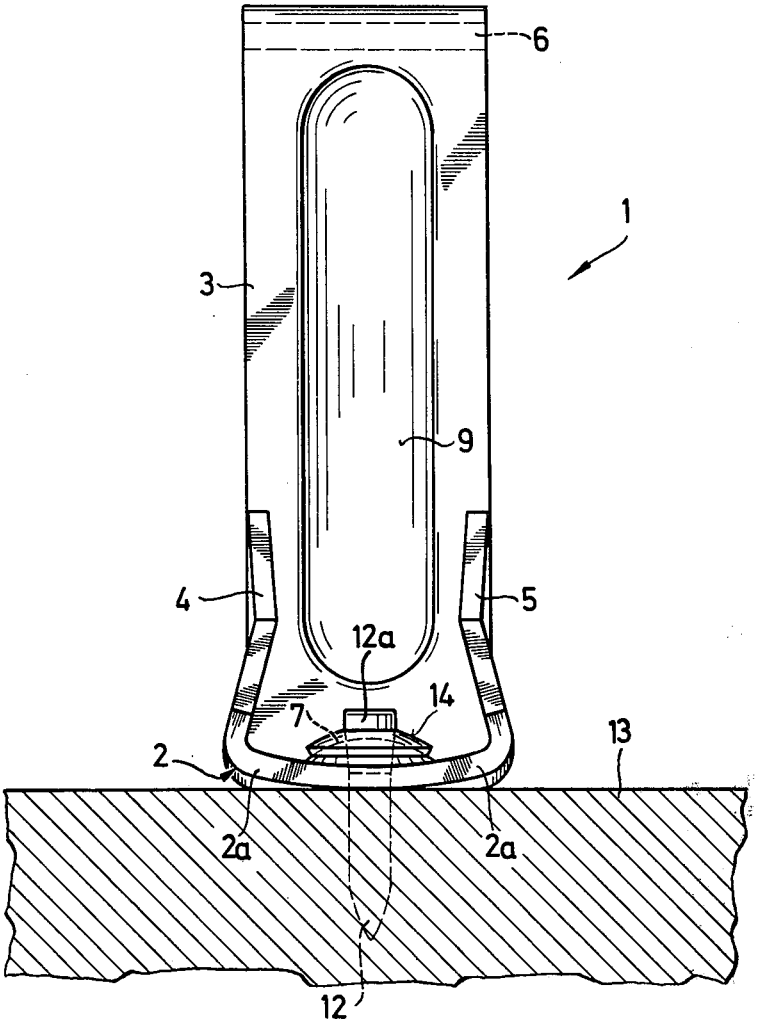
FIG. 4 is an end view of the connecting element shown in FIG. 3.

In FIGS. 3 and 4 a connecting element 1, as illustrated in FIG. 1, is secured on the upper surface of a girder 13 by means of a fastening element 12. As is clearly shown in FIG. 3, a certain amount of the material **13*a* forming the girder 13 has been displaced as the fastening element 12 was driven in with the material flowing upwardly into the frusto-conical cavity formed by the point of attachment 7 of the base member. As can be seen in FIG. 3 the downwardly facing surfaces of the points of attachment 7 have a concave configuration while the upwardly facing surfaces have a convex configuration. The flow of the material 13*a* of the girder 13 into the recess provides a formlocking connection between the girder and the base member 2 of the connecting element 1. Washers 14 are provided around the fastening elements in contact with the convex surfaces of the points of attachment so that the base member is prevented from being displaced over the heads of the fastening elements 12**.

To illustrate the deformation of the connecting element 1 under the application of stress, a force is shown applied in the direction of the arrow A, note FIG. 3, against the anchor strap 3 which is provided with the elongated corrugation-like recess 9 and the bent upper edge 6. Due to the application of the force, anchor strap 3 has undergone a slight deflection, increasing the angular relationship between the surfaces of the base member and the anchor strap and this deflection is transmitted to the supporting webs 4, 5. As can be seen in FIG. 4, the action of the anchor strap on the supporting webs, causes the webs to pull the elongated edges of the base member 2 slightly upwardly from the upper surface of the girder 13, note FIG. 4. Due to the deformation regions or zones **2*a* of the base member 2, the fastening elements securing the base member to the girder are only stressed to such an extent that the anchoring values are not reduced. By dimensioning the deformation zones 2*a* of the base member 2 by the proper selection of the material thickness and the extent of the deformation zones, it is possible to control the deflection of the anchor strap 3. This control can be enhanced by the shape and material thickness of the supporting webs which must substantially counteract the bending forces in case stress is applied as shown particularly in FIG. 4**.

The deflection of the anchor strap 3 itself can be controlled by its rigidity, which can be influenced by the design of the elongated corrugation-like recess 9 and the extent of the height of the supporting webs 4 and 5 along the anchor strap.

While a specific embodiment of the invention has been shown and described in detail to illustrate the application of the inventive principles, it will be understood that the invention may be embodied otherwise without departing from such principles.

I claim:

1. A connecting element for use in a composite beam structure formed of an upper concrete slab and a structural steel member depending downwardly from the concrete slab for connecting the concrete slab to the structural steel member, comprising a substantially L-shaped member, said L-shaped member including an elongated base member having a first face and an oppositely directed second face with a pair of laterally spaced first edges extending in the elongated direction of said base member along two opposite edges of said first and second faces and a pair of second edges spaced apart in and extending transversely of the elongated direction of said base member and extending along two other opposite edges of said first and second faces, an elongated anchor strap formed integrally with said base member and extending angularly from one of said second edges of said base member with the elongated direction of said anchor strap forming an angular continuation of the elongated direction of said base member so that the integrally formed said base member and anchor strap provide said member with its L-shape, said anchor strap having a first face and an oppositely directed second face with the first face thereof forming an angularly disposed continuation of the first face on said base member, said first face and second face having a pair of laterally spaced first edges extending in the elongated direction of said anchor strap and a pair of second edges spaced apart in and extending transversely of the elongated direction of said anchor strap, at least one opening extending through said base member between said first and second faces thereof with the opening being spaced inwardly from said first edges and said second edges, a fastening element insertible through the opening in said base member for securing said base member to a structural steel member of a composite beam structure by driving the fastening element into the structural steel member, supporting webs formed integrally with said base member along said first edges thereof and secured to said anchor strap along said first edges thereof, said base member having a deformation zone extending along each of the first edges thereof and located between said supporting webs and the opening through said base plate so that if a force is applied to said anchor strap increasing the angular displacement between the first faces of said anchor strap and said base member, said supporting webs effect a pulling force along the first edges of said base member with the deformation zone of said base member bending away from the structural steel member to which it is attached.

2. A connecting element, as set forth in claim 1, wherein said base member has at least two of the openings extending therethrough and spaced apart in the elongated direction thereof.

3. A connecting element, as set forth in claim 1, wherein said base member in the area surrounding said opening is deformed so that the surface of said first face encircling the opening has a convex configuration and the surface of said second face encircling the opening has a concave configuration whereby upon driving one said fastening element through said opening into a structural steel member, the material of the structural steel member displaced by said fastening element flows into the concave shaped surface of said second face and effects a form-locking engagement between the structural steel member and the base member of said L-shaped member.

4. A connecting element, as set forth in claim 1, wherein each of said supporting webs extends along and is integrally formed with one of the first edges of said base member for the full length of said first edge.

5. A connecting element, as set forth in claim 4, wherein each of said supporting webs is secured to one of the first edges of said anchor strap and extends for at least a part of the length of said first edge from the location of the securement of said anchor strap to said base member.

6. A connecting element, as set forth in claim 1, wherein said anchor strap has a corrugation-like recess formed in the first face thereof spaced inwardly from said first and second edges thereof and extending in the elongated direction of said anchor strap for increasing the rigidity of said anchor strap.

7. A connecting element, as set forth in claim 1, wherein said anchor strap at the opposite end from its securement to said base member is bent angularly to said first and second surfaces so that the bent portion extends in the direction facing outwardly from said second face of said anchor strap.

8. A connecting element, as set forth in claim 1, wherein a washer element is associated with each said fastening element and arranged to contact the first face of said base member so that said base member is prevented from being displaced over said fastening element.

9. A connecting element, as set forth in claim 1, wherein said first face and second face of said base member and said anchor strap are rectangular in shape.

10. A connecting element, as set forth in claim 9, wherein said supporting webs are approximately triangular in shape.

* * * * *